US006229968B1

(12) United States Patent
Martin et al.

(10) Patent No.: US 6,229,968 B1
(45) Date of Patent: May 8, 2001

(54) METHOD AND APPARATUS FOR DETECTING IMAGE MEDIUM SURFACE DEFECTS IN AN IMAGING SYSTEM

(75) Inventors: Michael J. Martin, Boise; John W. Huffman, Meridian; Nancy Cernusak, Eagle; Suzie Dustin, Meridian, all of ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/384,716

(22) Filed: Aug. 26, 1999

(51) Int. Cl.[7] ..... G03G 21/00; G03G 15/00

(52) U.S. Cl. ..... 399/34; 399/71; 399/99; 430/125

(58) Field of Search ..... 399/34, 45, 71, 399/98, 99, 101, 327, 343; 430/125

(56) References Cited

U.S. PATENT DOCUMENTS 4,967,238 * 10/1990 Bares et al. ..... 399/34
5,500,723 * 3/1996 Godlove ..... 399/34
5,521,692 * 5/1996 Bares ..... 399/26
5,678,134 * 10/1997 Miki et al. ..... 399/71
5,797,063 * 8/1998 Umezawa et al. ..... 399/34

* cited by examiner

*Primary Examiner*—Sophia S. Chen

(57) ABSTRACT

In an imaging system including at least one imaging medium transfer surface, an apparatus for detecting defects on the transfer surface is provided. The apparatus includes a scanner mechanism adapted and constructed to generate signals corresponding to a condition of the transfer surface. A processor is also provided. The processor is operatively connected to the scanner mechanism, and is adapted and constructed to receive and interpret signals from the scanner mechanism. In an imaging system including at least one imaging medium transfer surface, a method of detecting defects on an image medium surface is provided. The method includes the following steps. First, a scanning mechanism is provided. The scanning mechanism is adapted and constructed to generate signals corresponding to a condition of the transfer surface within the imaging system. Next, a defect is detected on the transfer surface by analyzing the signals generated by the scanning mechanism.

17 Claims, 5 Drawing Sheets

METHOD AND APPARATUS FOR DETECTING IMAGE MEDIUM SURFACE DEFECTS IN AN IMAGING SYSTEM

FIELD OF THE INVENTION

The present invention relates generally to image medium transfer surfaces of imaging systems. More specifically, the present invention relates to an apparatus and method for detecting image medium surface defects in an imaging system.

BACKGROUND OF THE INVENTION

Imaging systems such as printers, fax machines, and copiers are virtually omnipresent, and can be found in homes and offices worldwide. The development of such systems has facilitated improvements in communication that have in turn fostered an enormous change in the way people live and work. Telecommuting, paperless offices, and intra-office networks represent but a few examples of the advancements that have been made possible by modern imaging systems.

Imaging systems typically create printed images by transferring imaging medium, such as toner, to a sheet of material via a transfer assembly. In some known imaging systems, transfer assemblies are typically provided as pressure roller systems.

A variety of pressure roller systems are known that provide a multitude of functions for printing mechanisms, such as a printer fusing mechanism for fusing toner to print media in a laser printer or copier. The printer fusing mechanism melts carefully positioned toner particles, utilizing heat and pressure, onto print media with the printer fusing mechanism. However, both toner contamination and pressure roller material degradation can adversely affect the print quality of the output product.

For example, the type of print media affects the success of the fusing process. Where the print media is of a type where fusing the toner to the media is more difficult than with other types of print media, some of the toner may be transferred to a heated roller, and then back to a pressure roller of the printer fusing mechanism. Such unwanted transfer is referred to as toner contamination within the system. Once toner contamination is transferred to the pressure roller the contamination can be picked up by the back page of print media passing the pressure roller, or the contamination can be transferred again to the heated roller, and can randomly appear on the front page of print media passing the heated roller. In either case, the quality of the printed output from the printing mechanism is potentially degraded where toner contamination is present in the printing mechanism system. Additionally, contamination can cause print media to adhere to the roller and jam the fusing mechanism. Such jams are often serious enough to require a service call.

Furthermore, in order to output a product using the printer fusing mechanism, the pressure roller is necessarily subject to numerous heating and cooling cycles that can degrade the pressure roller material. Degradation of the pressure roller material can cause cracking and/or wrinkling of the pressure roller material along the length of the pressure roller. When the pressure roller material is sufficiently degraded, the output product is adversely affected, and print quality is reduced.

Such known defects as toner contamination and pressure roller material degradation both adversely affect the output product print quality and in fact are only discovered by a reduction in the quality of the output product print quality.

Currently, in an attempt to determine the nature of the defect, a number of "cleaning pages" are printed with the printer, or copier. Cleaning pages are typically provided as blank pages, or can incorporate precise patterns of printed material. If toner contamination is present on the pressure roller and/or the heater roller, successive cleaning pages can affect a decrease in the amount of toner contamination present. If the print quality is not improved once the cleaning pages have been printed, then replacement of the fusing mechanism is generally recommended, as it is assumed that the defect cannot be corrected by cleaning. Often, an insufficient number of cleaning pages are run through the printer or copier, and the fusing mechanism is needlessly replaced, affecting both printer downtime and warranty or service costs. Further, the number of output products adversely affected by a reduction in printer quality, as well as the number of cleaning pages needed to effectively clean the pressure and heated rollers, could be reduced if a defect in the printer fusing mechanism could be more readily detected.

SUMMARY OF THE INVENTION

In an imaging system including at least one imaging medium transfer surface, an apparatus for detecting defects on the transfer surface is provided. The apparatus includes a scanner mechanism adapted and constructed to generate signals corresponding to a condition of the transfer surface. A processor is also provided. The processor is operatively connected to the scanner mechanism, and is adapted and constructed to receive and interpret signals from the scanner mechanism.

The processor can include a central processing unit (CPU) of the imaging system. The scanner mechanism can include a reflective sensor. Alternatively, the scanner mechanism can include a lens focused to a charge coupled device (CCD) array for viewing a predetermined length of the transfer surface of the imaging system.

The imaging system can be a laser printer and the transfer surface can be a pressure roller. The imaging system can be a device selected from the group consisting of copiers, printers, and fax machines, wherein the transfer surface includes a pressure roller. The apparatus can include a digital circuit. The digital circuit can be connected to the scanner mechanism and to the processor. The digital circuit provides a digital output signal from the scanner mechanism to the processor.

The apparatus can include an analysis routine, stored in the processor, for determining when a defect is detected. Alternatively, an analysis circuit can be connected to the scanning mechanism and to the processor. The apparatus can include a processor connected to a DC controller. The apparatus can include a cleaning page adapted to be fed to the image medium surface via the DC controller during a cleaning cycle of the imaging system, and a control routine, associated with the processor, for directing the DC controller to automatically run the cleaning cycle. Alternatively, a cleaning page adapted to be fed to the image medium surface during a cleaning cycle of the imaging system can be provided, and a control device, associated with the processor can be provided, for prompting a user of the imaging system to initiate a cleaning cycle of the imaging system.

A method of detecting defects on an image medium surface in an imaging system is also provided. The method includes the following steps. First, a scanning mechanism is provided. The scanning mechanism is adapted and constructed to generate signals corresponding to a condition of the transfer surface within the imaging system. Next, a defect is detected on the transfer surface by analyzing the signals generated by the scanning mechanism.

The method can further include the following steps: operating the imaging system to actuate the transfer surface, and performing the step of detecting a defect while the transfer surface is actuated.

The method can include the step of automatically initiating a cleaning cycle of the imaging system when the step of detecting a defect indicates the presence of a defect on the transfer surface.

The method can include the steps of providing a cleaning page adapted to be fed to the image medium surface during a cleaning cycle of the imaging system, and prompting a user of the imaging system to initiate a cleaning cycle of the imaging system when the step of detecting a defect indicates the presence of a defect on the transfer surface.

The method can also include the steps of repeating the step of automatically initiating a cleaning cycle a predetermined number of times, repeating the step of detecting a defect after each cleaning cycle, and if no defect is detected after the predetermined number of cleaning cycle repetitions, prompting the user via a display panel on the imaging system that the cleaning cycle is complete, and if a defect is detected after the predetermined number of cleaning cycle repetitions, prompting the user via a display panel on the imaging system that the transfer surface should be replaced.

The method can also include the steps of, if a defect is detected after a first cleaning cycle, prompting a user of the imaging system to repeat the cleaning cycle of the imaging system when the step of detecting a defect indicates the presence of a defect on the transfer surface after the first cleaning cycle. If a defect is detected after a repetition of the cleaning cycle, the method includes the step of repeating the step of prompting a user of the imaging system to repeat a cleaning cycle up to a predetermined maximum number of times. If no defect is detected after any cleaning cycle, the user is prompted, via a display panel on the imaging system, that the cleaning cycle is complete. If a defect is detected after the maximum predetermined number of cleaning cycle repetitions, the user is prompted, via a display panel on the imaging system, that the transfer surface should be replaced.

The features of the invention believed to be patentable are set forth with particularity in the appended claims. The invention itself, however, both as to organization and method of operation, together with further objects and advantages thereof, may be best understood by reference to the following description taken in conjunction with the accompanying drawings.

DETAILED DESCRIPTION OF THE INVENTION

Figure 1:
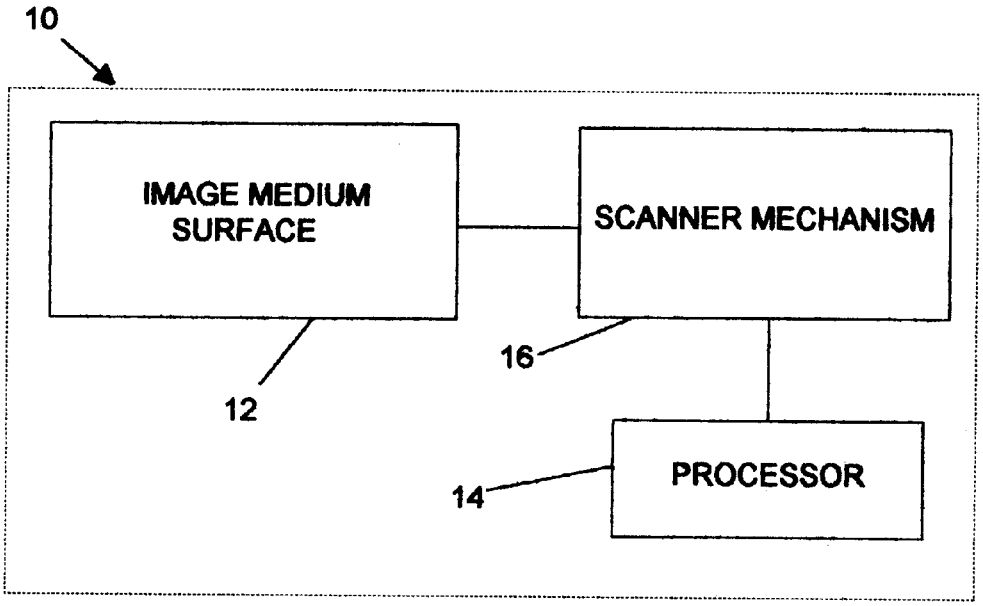
FIG. 1 illustrates a schematic diagram of an exemplary embodiment of an apparatus of the present invention.

As illustrated in FIG. 1, an apparatus constructed in accordance with the inventive principles discussed herein includes an imaging system, shown generally at 10. The imaging system includes an image medium surface 12 and at least one suitable processor 14. As used herein, the term "imaging systems" includes all devices having an integrated or associated image medium surface, wherein defects arising from use and/or wear of the transfer surface have the potential to adversely affect the quality of the product output of the imaging system. Examples of such imaging systems include, but are not limited to, printers, copiers, and fax machines. The processor 14 can be an integrated or an associated processor, such as a CPU of the imaging system, or a processor of a peripherally connected device, such as a computer.

The benefits of rapid defect detection provided by the present invention are realized by providing a scanner mechanism 16 operatively connected to the processor 14. The processor 14 is adapted and constructed to receive and interpret signals from the scanner mechanism 16. The scanner mechanism 16 is adapted and constructed to generate signals corresponding to a condition of the transfer surface. The scanner mechanism 16 can include any suitable arrangement for collecting meaningful data from the transfer surface under the operating constraints of a particular system.

For example, where the scanner mechanism 16 is subjected to heating and cooling of a particular imaging system 10, the scanner mechanism 16 must be selected to tolerate temperature fluctuations. Where the imaging system 10 is a printer, copier, or fax machine, suitable scanner mechanisms 16 can include a reflective sensor, a lens attached to a CCD array, or any other suitable scanning mechanism for collecting data under the operating conditions of the imaging device. Further, the arrangement of the scanner mechanism 16 can include as few as one sensor to as many as an array of sensors to scan the entire transfer surface.

In a simple embodiment, the imaging system 10 is a laser printer, the transfer surface 12 is a pressure roller, the processor 14 is an application specific integrated circuit, or ASIC, associated with a DC controller, and the scanning mechanism 16 is a suitable sensor, such as a HONEYWELL HOA0708 reflective sensor. The reflective sensor is aimed at the pressure roller, and recognizes defects that occur on the roller surface. The sensor should be positioned to achieve an optimal focal length from the roller surface to the sensor face. The number of sensors provided in the scanning mechanism 16 can vary from as many as one to as many required to scan the entire surface of the pressure roller. The number of sensors can be selected based on the desired degree of accuracy of defect detection, and/or the costs and complexity involved in achieving the desired results.

In a more complicated embodiment, where the imaging system 10 is a laser printer, the scanning mechanism 16 could include a lens for viewing the entire pressure roller length, where the lens is focused to a CCD array. It has been found that this system has the capability of detecting defects on pressure rollers made of different materials, such as foam or hard rubber. Specifically, it has been found that this system can recognize toner deposits on both black and orange rollers, and wrinkles on orange rollers.

Figure 2:
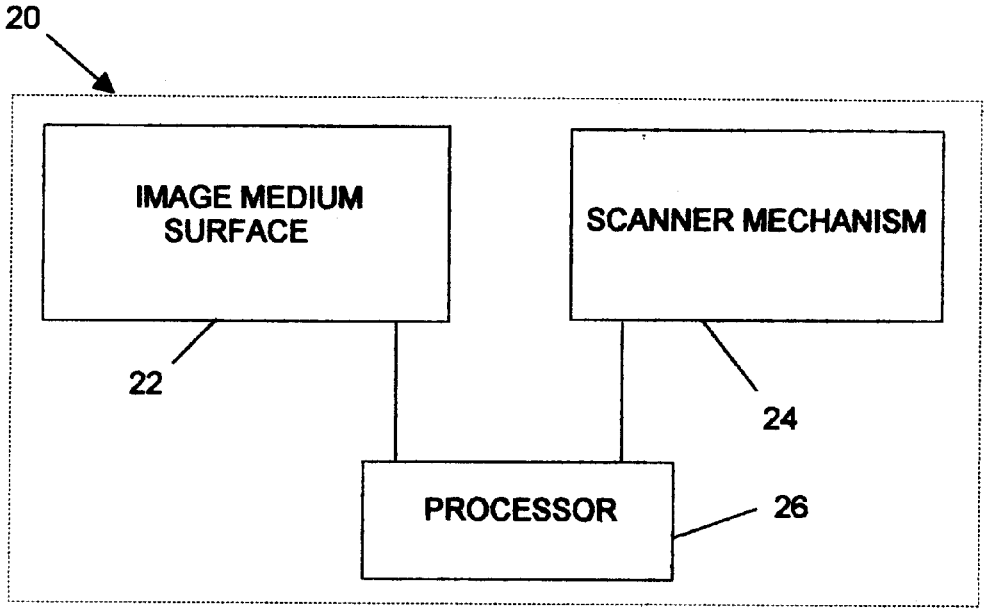
FIG. 2 illustrates a schematic diagram of another exemplary embodiment of an apparatus of the present invention.

As illustrated in FIG. 2, an imaging system 20 can include both a transfer surface 22 and a scanning mechanism 24 connected to a suitable processor 26. As discussed above with reference to FIG. 1, the processor 26 can be either integrated in the imaging system 20 or associated with the imaging system 20.

Figure 3:
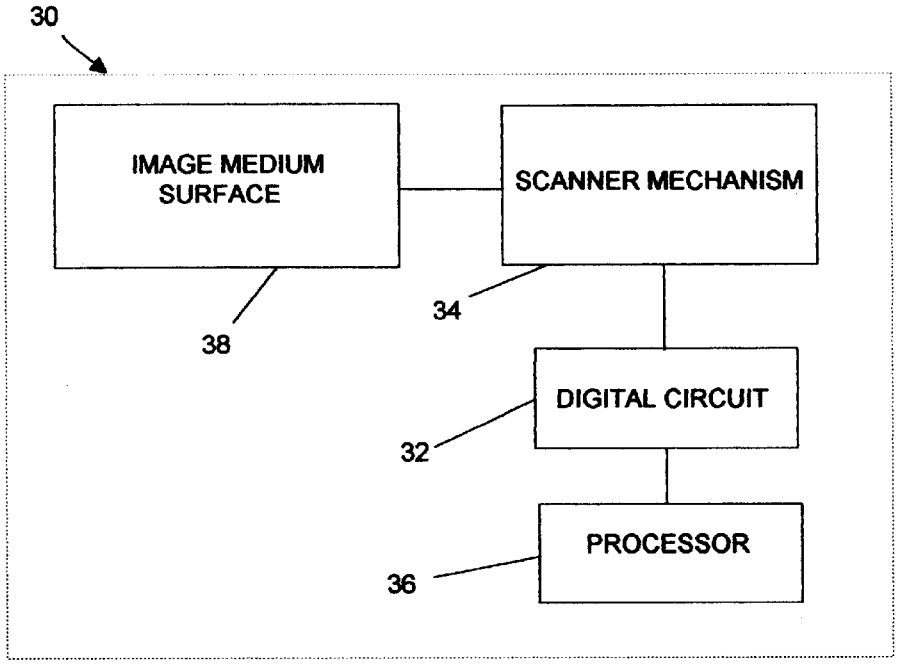
FIG. 3 illustrates a schematic diagram of yet another exemplary embodiment of an apparatus of the present invention.

As illustrated in FIG. 3, an imaging system 30 can include a digital circuit 32 provided between a scanner mechanism 34 and a processor 36. A digital circuit to detect defects of an imaging medium transfer surface 38 may be included, where necessary or desired, to convert the sensor output to a digital output. As is known to those of skill in the art, numerous digital circuits, or digital components, can convert a signal output to a digital output. All such circuits and components are contemplated by the inventors as being within the scope of the inventive principles discussed herein.

Figure 4:
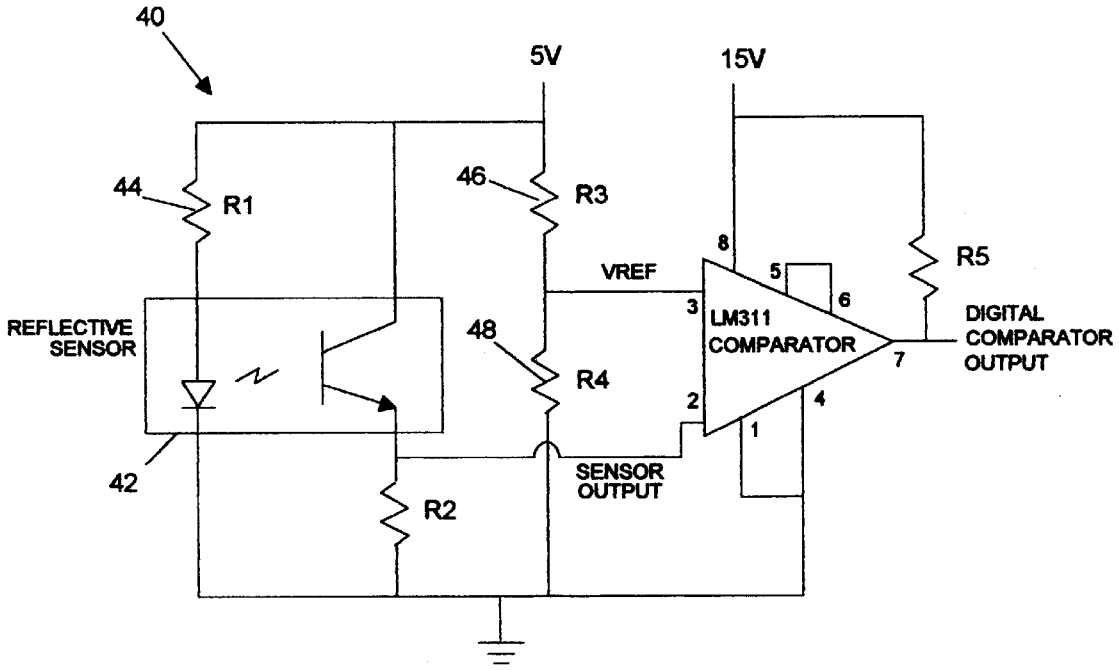
FIG. 4 illustrates a circuit diagram of a suitable digital circuit that can be used in the apparatus shown in FIG. 3.

One simple digital circuit 40 with which a digital output can be achieved is illustrated in FIG. 4. An infrared emitting diode of a reflective sensor 42, such as a HONEYWELL HOA0708 is connected to a pull-up resistor R1, shown at 44. The digital circuit 40 also includes resistors R2 through R5, and a comparator, here shown as an LM311 comparator having pins 1 through 8. A reference voltage (Vref) is provided between pull-up resistor R3, shown at 46 and connected in series with pull-down resistor R4, shown at 48. The output voltage of the reflective sensor 42 can be adjusted by altering the value of R1. By altering R1 and R4, a stronger digital output from a suitable comparator is achieved. For example, it was found that a stronger digital output could be achieved when converting the output signal generated by scanning a black foam roller by altering R1 and R4. Although such a circuit may require adjustment to work well with rollers of different colors, the circuit is effective in identifying surface irregularities. Determining the nature of the defect, i.e., toner contamination or wrinkle/cracks could be determined by firmware.

Figure 5:
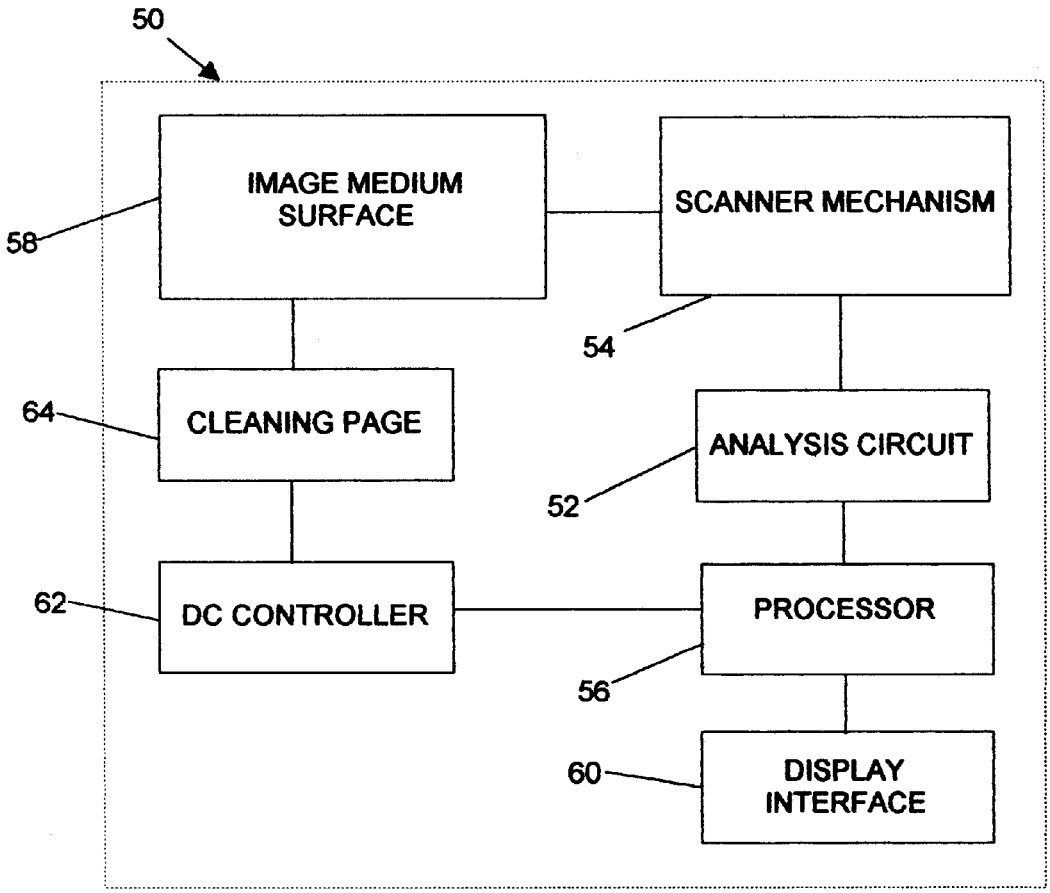
FIG. 5 illustrates a schematic diagram of still another exemplary embodiment of an apparat us of the present invention.

Referring now to FIG. 5, another exemplary apparatus includes an imaging system 50. An analysis circuit 52 is connected between a scanning mechanism 54 and a processor 56. The analysis circuit 52 can also be integrated in the processor 56. In this configuration, the scanning mechanism 54 can constantly feed output data to the analysis circuit 52. The processor 56 can enable receipt of data from the analysis circuit 52 when the transfer surface 58 is actuated. The processor 56 can then display a prompt, based on the data from the analysis circuit 52, to a display interface 60. For example, the prompt could request insertion of a cleaning page, a call to customer service, or any other appropriate prompt. If the imaging system 50 is sophisticated enough, the cleaning process could be automatically initiated by the processor 56, and the prompt could inform a user that the imaging system 50 is performing a cleaning cycle. In order to automate the cleaning cycle, a DC controller 62 is driven by the processor 56. The DC controller 62 can be connected to or integrated in the processor 56. The DC controller 62 can initiate feeding of a cleaning page 64 to the transfer surface 58.

Figure 6:
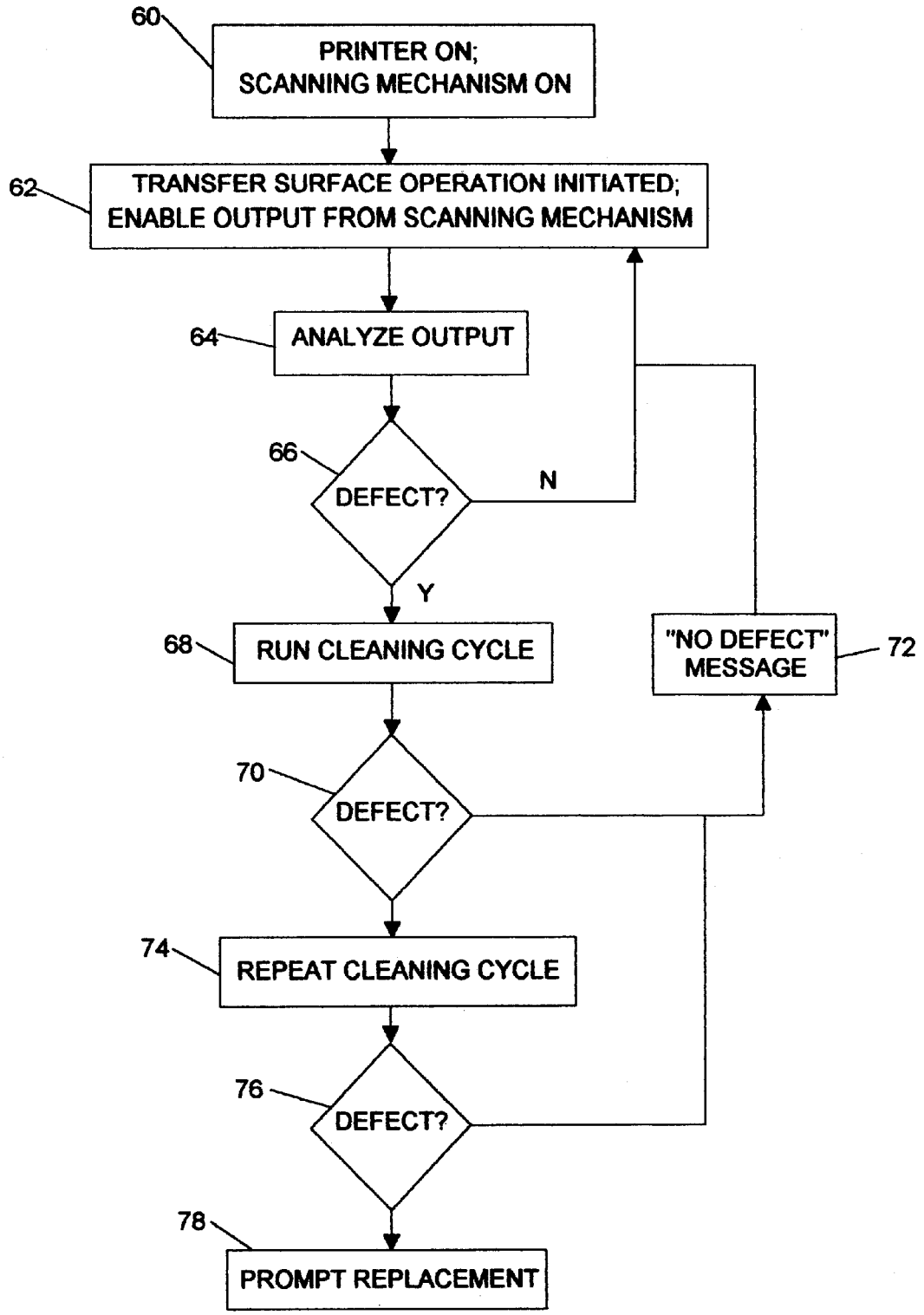
FIG. 6 illustrates a flow chart of the method of the present invention.

A method of detecting defects on an image medium surface, and automatically dealing with such defects, is described in FIG. 6. The method is described in the context of an imaging system including at least one imaging medium transfer surface, as described in FIGS. 1 through 5. In a first step indicated at point 60, the imaging system and associated scanner mechanism are activated. Next, at point 62, the transfer surface is actuated, and the scanning mechanism generates signals corresponding to a condition of the transfer surface within the imaging system. At point 64, the signals output by the scanning mechanism are analyzed to detect any defect on the transfer surface. If, as at point 66, no defects are detected, operation of the imaging system continues, and the scanning mechanism continues to monitor transfer surface condition.

If, as indicated at point 66, the step of detecting a defect indicates the presence of a defect on the transfer surface, a control system of the imaging system initiates a cleaning cycle at point 68 in which a cleaning page is fed to the image medium surface. If, after the cleaning cycle has been completed, no defects are detected, operation of the imaging system continues, and the scanning mechanism continues to monitor transfer surface condition as shown at point 70. The user can be prompted, via a display panel on the imaging system, that the cleaning cycle is complete at point 72.

If, after the first cleaning cycle is completed, a defect is detected, the cleaning cycle is repeated, automatically initiating the cleaning cycle up to a predetermined number of times as indicated at point 74. The step of detecting a defect is repeated after each cleaning cycle. If, after the completion of any cleaning cycle, no defect is detected, the user can be prompted, via a display panel on the imaging system, that the cleaning cycle is complete at point 72.

If a defect persists after a predetermined number of cleaning cycle repetitions at point 76, the user can be prompted at point 78, via a display panel on the imaging system, that the transfer surface should be replaced. Although the risk of print quality degradation would be high, the imaging system would remain functional until such time as the transfer surface were replaced.

Figure 7:
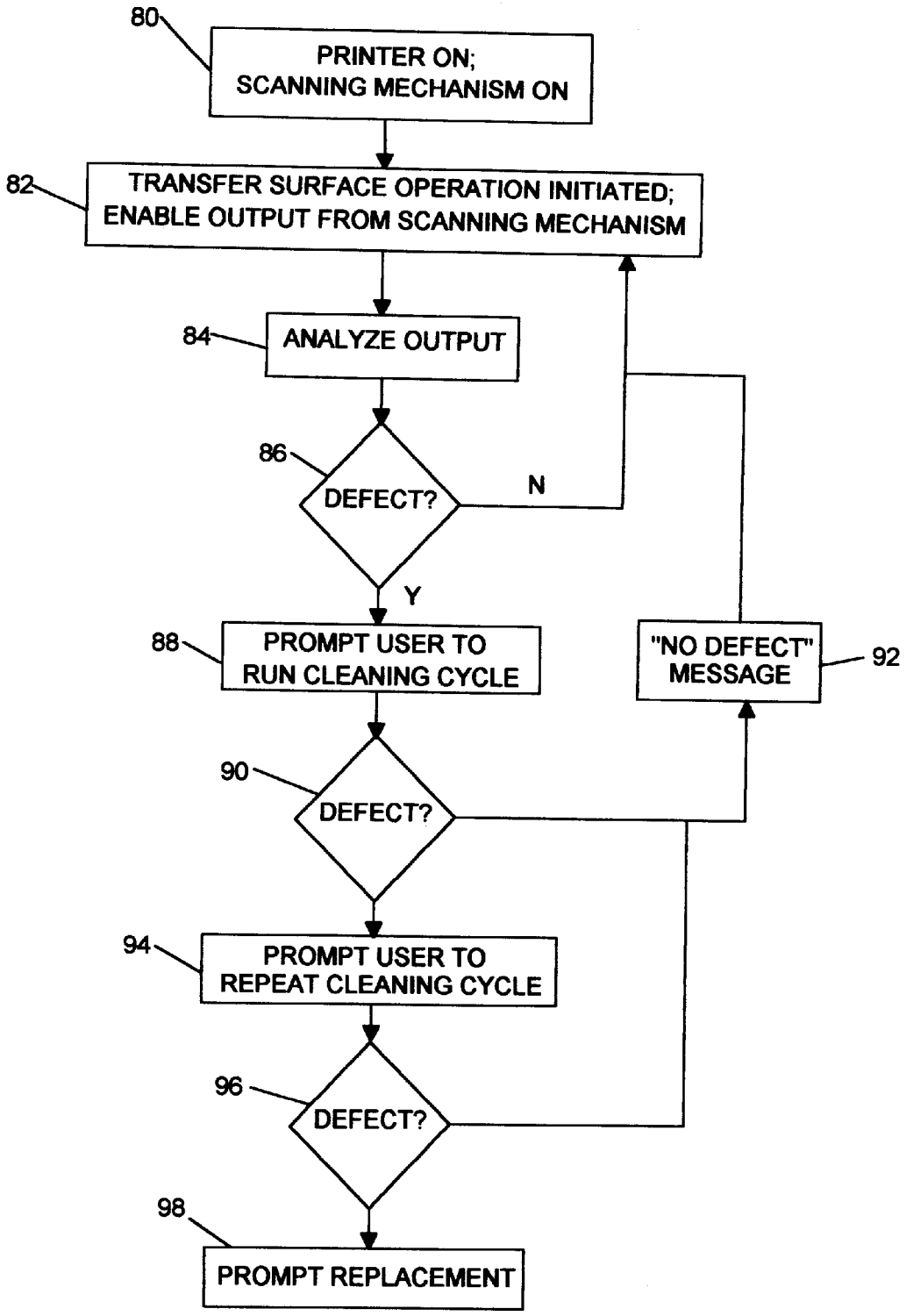
FIG. 7 illustrates another flow chart of the method of the present invention.

A method of detecting defects on an image medium surface, and manually dealing with such defects, is described in FIG. 7. As with the previously-described method, the FIG. 7 method is described in the context of an imaging system including at least one imaging medium transfer surface, as described in FIGS. 1 through 5. In a first step indicated at point 80, the imaging system and associated scanner mechanism are activated. Next, at point 82, the transfer surface is actuated, and the scanning mechanism generates signals corresponding to a condition of the transfer surface within the imaging system. At point 84, the signals output by the scanning mechanism are analyzed to detect any defect on the transfer surface. If, at point 86, no defects are detected, operation of the imaging system continues, and the scanning mechanism continues to monitor transfer surface condition.

If, as indicated at point 86, the step of detecting a defect indicates the presence of a defect on the transfer surface, a user of the imaging system is prompted to initiate a cleaning cycle in which a cleaning page is fed to the image medium surface at point 88. If, after the cleaning cycle has been completed, no defects are detected at point 90, operation of the imaging system continues, and the scanning mechanism continues to monitor transfer surface condition. The user can be prompted, via a display panel on the imaging system, that the cleaning cycle is complete at point 92.

If, after the first cleaning cycle is completed, a defect is detected at point 90, the user of the imaging system is prompted to repeat the cleaning cycle at point 94. The step of detecting a defect is repeated after each cleaning cycle. If, after the completion of any cleaning cycle, no defect is detected, the user can be prompted, via a display panel on the imaging system, that the leaning cycle is complete at point 92. Although print quality would potentially be degraded, the imaging system would remain functional until replacement of the transfer surface.

If a defect persists after a predetermined number of cleaning cycle repetitions at point 96, the user can be prompted at point 98, via a display panel on the imaging system, that the transfer surface should be replaced.

Although the present invention has been described with reference to specific embodiments, those of skill in the art will recognize that changes may be made thereto without departing from the scope and spirit of the invention as defined by the appended claims.

What is claimed is:

1. In an imaging system including at least one imaging medium transfer surface adapted to transfer imaging medium from the imaging medium transfer surface to sheet material passing through the system, an apparatus for detecting defects on the transfer surface comprising the following:

a scanner mechanism adapted and constructed to generate signals corresponding to a condition of the transfer surface; and a processor, operatively connected to the scanner mechanism, adapted and constructed to receive and interpret signals from the scanner mechanism, wherein the scanner mechanism comprises a lens focused to a CCD array for viewing a predetermined length of the transfer surface of the imaging system.

2. An apparatus as claimed in claim 1, wherein the transfer surface is connected to the processor.

3. An apparatus as claimed in claim 2, wherein the processor comprises a central processing unit (CPU) of the imaging system.

4. An apparatus as claimed in claim 1, wherein the scanner mechanism comprises a reflective sensor.

5. An apparatus as claimed in claim 1, wherein the imaging system comprises a laser printer and wherein the transfer surface comprises a pressure roller.

6. An apparatus as claimed in claim 1, wherein the imaging system comprises a device selected from the group consisting of copiers, printers, and fax machines, and wherein the transfer surface comprises a pressure roller.

7. An apparatus as claimed in claim 1, further comprising digital circuit means, connected to the scanner mechanism and to the processor, for providing a digital output signal from the scanner mechanism to the processor.

8. An apparatus as claimed in claim 1, further comprising an analysis routine stored in the processor for determining when a defect is detected.

9. In an imaging system including at least one imaging medium transfer surface adapted to transfer imaging medium from the imaging medium transfer surface to sheet material passing through the system, an apparatus for detecting defects on the transfer surface comprising the following:

a scanner mechanism adapted and constructed to generate signals corresponding to a condition of the transfer surface;

a processor, operatively connected to the scanner mechanism, adapted and constructed to receive and interpret signals from the scanner mechanism; and an analysis circuit connected to the scanner mechanism and to the processor.

10. In an imaging system including at least one imaging medium transfer surface adapted to transfer imaging medium from the imaging medium transfer surface to sheet material passing through the system, an apparatus for detecting defects on the transfer surface comprising the following:

a scanner mechanism adapted and constructed to generate signals corresponding to a condition of the transfer surface; and a processor, operatively connected to the scanner mechanism, adapted and constructed to receive and interpret signals from the scanner mechanism, wherein a DC controller is incorporated in the processor.

11. An apparatus as claimed in claim 10, further comprising the following:

a cleaning page adapted to be fed to the imaging medium transfer surface via the DC controller during a cleaning cycle of the imaging system; and a control routine, associated with the processor, for directing the DC controller to automatically run the cleaning cycle.

12. In an imaging system including at least one imaging medium transfer surface adapted to transfer imaging medium from the imaging medium transfer surface to sheet material passing through the system, an apparatus for detecting defects on the transfer surface comprising the following:

a scanner mechanism adapted and constructed to generate signals corresponding to a condition of the transfer surface;

a processor, operatively connected to the scanner mechanism, adapted and constructed to receive and interpret signals from the scanner mechanism;

a cleaning page adapted to be fed to the imaging medium transfer surface during a cleaning cycle of the imaging system; and control means, associated with the processor, for prompting a user of the imaging system to initiate a cleaning cycle of the imaging system.

13. In an imaging system including at least one imaging medium transfer surface adapted to transfer imaging medium from the imaging medium transfer surface to sheet material passing through the system, a method of detecting defects on the imaging medium transfer surface, the method comprising the following steps:

providing a scanning mechanism adapted and constructed to generate signals corresponding to a condition of the transfer surface within the imaging system;

detecting a defect on the transfer surface by analyzing the signals generated by the scanning mechanism;

providing a cleaning page adapted to be fed to the image medium transfer surface during a cleaning cycle of the imaging system; and prompting a user of the imaging system to initiate a cleaning cycle of the imaging system when the step of detecting a defect indicates the presence of a defect on the transfer surface.

14. A method as claimed in claim 13, further comprising the following steps:

operating the imaging system to actuate the transfer surface; and performing the step of detecting a defect while the transfer surface is actuated.

15. A method as claimed in claim 13, further comprising the step of automatically initiating a cleaning cycle of the imaging system when the step of detecting a defect indicates the presence of a defect on the transfer surface.

16. A method as claimed in claim 15, further comprising the following steps:

repeating the step of automatically initiating a cleaning cycle a predetermined number of times;

repeating the step of detecting a defect after each cleaning cycle;

if no defect is detected after the predetermined number of cleaning cycle repetitions, providing a prompt via a display panel on the imaging system that the cleaning cycle is complete; and if a defect is detected after the predetermined number of cleaning cycle repetitions, providing a prompt via a display panel on the imaging system that the transfer surface should be replaced.

17. A method as claimed in claim 13, further comprising the following steps:

if a defect is detected after a first cleaning cycle, providing a prompt to repeat the cleaning cycle of the imaging system when the step of detecting a defect indicates the presence of a defect on the transfer surface after the first cleaning cycle;

if a defect is detected after a cleaning cycle, repeating the step of providing a prompt to repeat a cleaning cycle up to a predetermined maximum number of times;

if no defect is detected after any cleaning cycle, providing a prompt via a display panel on the imaging system that the cleaning cycle is complete; and if a defect is detected after the maximum predetermined number of cleaning cycle repetitions, providing a prompt via a display panel on the imaging system that the transfer surface should be replaced.

* * * * *